United States Patent [19]

Tung

[11] Patent Number: 4,979,155

[45] Date of Patent: Dec. 18, 1990

[54] STRUCTURE OF CLOCK

[76] Inventor: Huang C. Tung, No. 34 Lane 17, Wei Shea Road, I-Lan, Taiwan

[21] Appl. No.: 519,208

[22] Filed: May 3, 1990

[51] Int. Cl.[5] ..... G04B 19/04

[52] U.S. Cl. ..... 368/80; 368/223; 368/228

[58] Field of Search ..... 368/76, 80, 88, 223–238

[56] References Cited

U.S. PATENT DOCUMENTS 1,807,497 5/1931 Speciale ..... 368/228

2,361,563 10/1944 Pellaton ..... 368/228

*Primary Examiner*—Vit W. Miska

*Attorney, Agent, or Firm*—Lowe, Price, LeBlanc, Becker & Shur

[57] ABSTRACT

A clock, the hour and minute hands of which are each bilaterally extending outward from respective mounting shaft and driven to rotate at half speed relative to the hour and minute hands of the conventional clock. A cover plate which has a thermometer, a hygrometer and a digital display timepiece thereon is covered on part of a dial plate permitting parts of the hour and minute hands to expose on such a dial plate for indication of time.

3 Claims, 4 Drawing Sheets

STRUCTURE OF CLOCK

BACKGROUND OF THE INVENTION

The present invention is related to clocks and more particularly to a clock the hour and minute hands of which are respectively driven to rotate at half speed, relative to the hour and minute hands of the conventional clock, for indicating time over the upper half part of a dial plate.

A clock generally has dial plate marked with figures around its circumference, and an hour hand, a minute hand and a seconds hand respectively driven by a hour shaft, a minute shaft and a seconds shaft to rotate on the dial plate for indicating time. It is an idea of the present inventor to design a clock which operates in an unique manner absolutely different from the conventional clock so that accurate time indication can be achieved by means of a hour hand and a minute hand running over the upper half part of a dial plate. The hour and minute hands have each two opposite ends symmetrically extending outward and are driven to rotate at half speed relative to the hour and minute hands of the conventional clock, and the dial plate has a series of numerals from 1 to 12 equidistantly marked around the circumference of the upper half part of the dial plate. When one end of the hour or minute hand passes through the numerals on the upper half part of the dial plate, the other end of the hour or minute hand passes through the plain area of the lower half part of the dial plate. By means of the foregoing arrangement, the function of accurate time indication is not affected.

SUMMARY OF THE INVENTION

The present invention is to provide a clock which comprises a cover plate covering over the lower half part of a dial plate defining a gap therebetween. A series of figures from 1 to 12 are marked on the upper half part of the dial plate. The hour and minute hands of the clock have each a mounting shaft in the middle on its bottom surface and driven to rotate at half speed relative to the hour and minute hands of the conventional clock. One end of the hour or minute hand appears on the upper half part of the dial plate for indication of time, the other end is disappeared from the dial plate and merged inside the gap between the dial plate and the cover plate.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
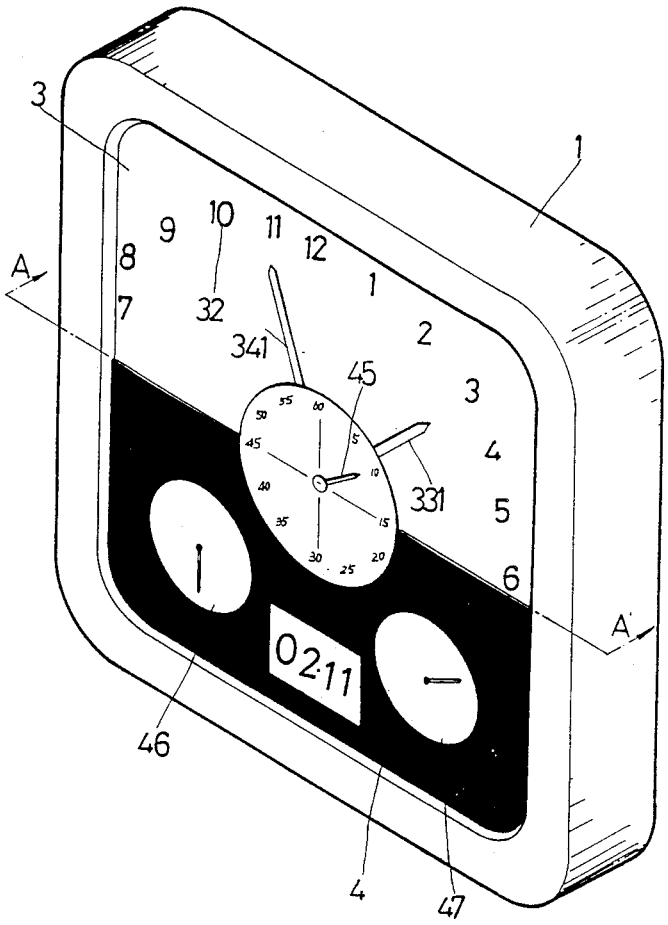
FIG. 1 is a perspective view of a clock embodying the present invention.
Figure 2:
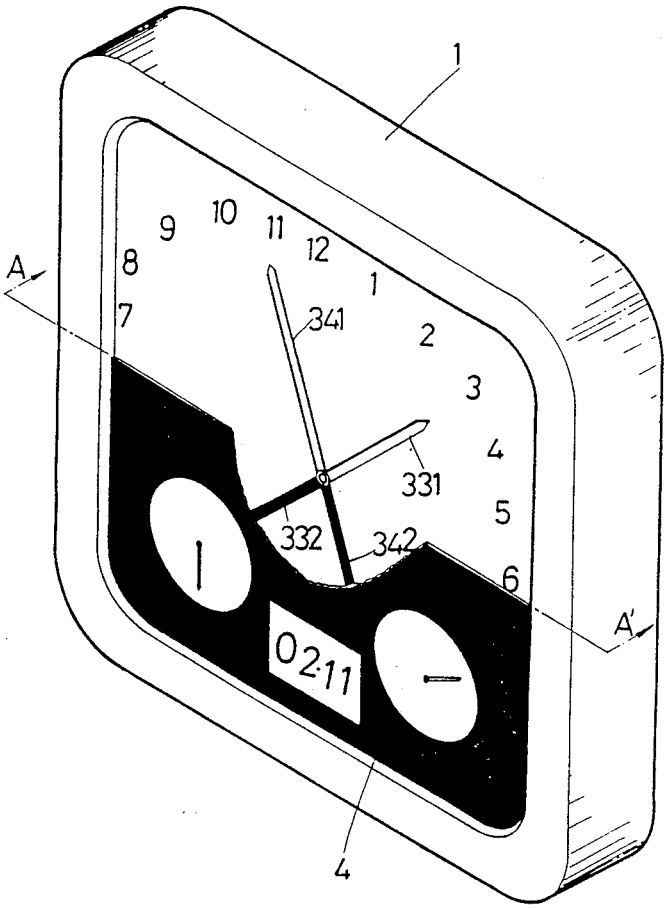
FIG. 2 is a partly perspective view thereof, in which the circle of the cover plate is removed.
Figure 3:
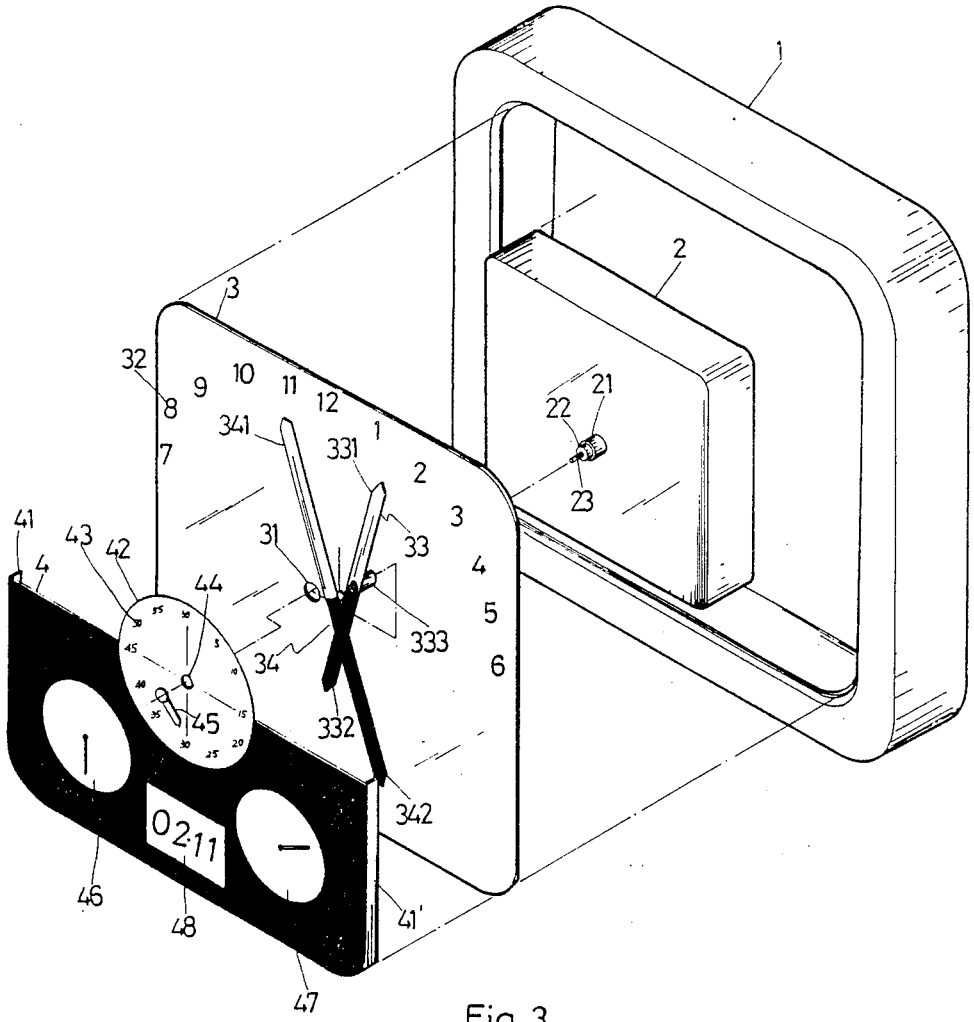
FIG. 3 is a perspective fragmentary view thereof.
Figure 4:
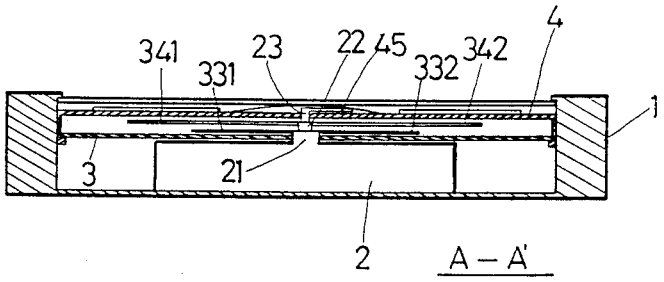
FIG. 4 is a transversely cross sectional view thereof.

Referring to FIGS. 1 and 3, a clock comprises a casing 1 having a movement 2 to drive an hour shaft 21, a minute shaft 22 and a seconds shaft 23 to rotate. A dial plate 3 is mounted on the movement 2 permitting the shafts 21, 22, 23 to protrude beyond the center hole 31 thereof. There is provided an hour hand 33 and a minute hand 34 which have each a mounting shaft 333 or 343 extending downward from its center for mounting on the hour shaft 21 and minute shaft 22 respectively.

There is a cover plate 4 in half size of the dial plate 3 which is mounted on the casing 1 in front of the dial plate 3. The cover plate 4 has two folded edges 41, 41' on its two opposite, lateral sides and a circle 42 on its top at the center of its topmost edge. The circle 42 is designed in such a manner that the upper half portion of which projects upward from the topmost edge of the cover plate 4 and the lower half portion of which is merged into the cover plate 4. The circumference of the circle 42 is divided into 60 units marked with respective FIGS. 43. A hole 44 is made at the center of the circle 42 so that the seconds shaft 23 of the movement 2 can be inserted therethrough to couple with a seconds hand 45. Because of the design of the two bilateral folded edges 41, 41' a space 411 is maintained between the dial plate 3 and the cover plate 4 after the cover plate 4 is mounted on the casing 1 so that the hour hand 33 and the second hand 34 are permitted to smoothly rotate within such a space 411. Additionally, a thermometer 46, a hygrometer 47 and a digital display timepiece 48 may be respectively mounted on the cover plate 4. According to the present invention, the dial plate 3 has FIGS. 32 of twelve hours printed on its upper half part and the cover plate 4 is made of opaque material. After the cover plate 4 is mounted on the casing 1 in front of the dial plate 3, the lower half part of the dial plate 3 is concealed from viewing outside. Because the operational speed of the movement 2 is set at half speed relative to the conventional clocks, accurate indication of hour and minute is indicated by the hour and minute hands 33, 34 when the hour and minute hands 33, 34 pass through the upper half part of the dial plate 3.

What is claimed is:

1. A clock, comprising:

a casing;

a movement mounted inside said casing at the center thereof to drive an hour shaft, a minute shaft and a seconds shaft to rotate, permitting said hour shaft and said minute shaft to rotate at half speed relative to the hour shaft and minute shaft of the conventional clock and permitting said seconds shaft to rotate at equal speed of the seconds shaft of the conventional clock;

a dial plate mounted on said casing covering over said movement, said dial plate having a center hole for the penetration therethrough of said hour shaft, said minute shaft and said seconds shaft and having figures on its upper half part for indication of hours;

an hour hand having a mounting shaft extending downward from its bottom in the middle and fastened in said hour shaft;

a minute hand having a mounting shaft extending downward from its bottom in the middle and fastened in said minute shaft;

a cover plate in half size of said dial plate having two folded edges on its two opposite, lateral sides and a seconds dial face circle at the center of its topmost edge, said circle having its upper half portion projecting upward from the topmost edge of said cover plate and its lower half portion merged into said cover plate and having a center hole for the penetration therethrough of said seconds shaft, said cover plate being mounted on said casing covering over the lower half part of said dial plate defining a space therebetween; and a seconds hand having a mounting shaft extending downward from its bottom at one end and fastened in said seconds shaft.

2. A clock as claimed in claim 1, wherein said cover plate has a thermometer, a hygrometer and a digital display timepiece mounted thereon and is made of opaque material with patterns printed thereon.

3. A clock as claimed in claim 1, wherein said figures on said dial plate include a numeral 12 in the center and a series of numerals from 7 to 11 on the left side and a series of numerals from 1 to 6 on the right side, and said hour hand has one half part marked in dark color for indication of night when the dark colored half part of said hour hand appears within the area of said figures.

* * * * *